US006886921B2

(12) United States Patent
Cornell

(10) Patent No.: US 6,886,921 B2
(45) Date of Patent: May 3, 2005

(54) THIN FILM HEATER RESISTOR FOR AN INK JET PRINTER

(75) Inventor: Robert Wilson Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 144 days.

(21) Appl. No.: 10/405,563

(22) Filed: Apr. 2, 2003

(65) Prior Publication Data

US 2004/0196334 A1 Oct. 7, 2004

(51) Int. Cl.[7] ..... B41J 2/05
(52) U.S. Cl. ..... 347/62
(58) Field of Search ..... 347/56, 62, 63; 219/216, 541; 338/306–309

(56) References Cited

U.S. PATENT DOCUMENTS

| | | | | |
|---|---|---|---|---|
| 4,339,762 A | | 7/1982 | Shirato et al. | 347/62 |
| 4,712,930 A | | 12/1987 | Maruno et al. | 347/183 |
| 4,725,859 A | | 2/1988 | Shibata et al. | 347/58 |
| 4,870,433 A | | 9/1989 | Campbell et al. | 347/62 |
| 4,914,562 A | * | 4/1990 | Abe et al. | 347/63 |
| 4,947,189 A | | 8/1990 | Braun et al. | 347/62 |
| 4,947,193 A | | 8/1990 | Deshpande | 347/62 |
| 5,559,543 A | | 9/1996 | Komuro | 347/62 |
| 5,639,386 A | | 6/1997 | Burke et al. | 216/27 |
| 5,694,191 A | | 12/1997 | Strathman et al. | 349/161 |
| 5,808,640 A | | 9/1998 | Bhaskar et al. | 347/62 |
| 6,123,419 A | | 9/2000 | Cleland | 347/62 |
| 6,139,130 A | * | 10/2000 | Takahashi et al. | 347/62 |
| 6,276,775 B1 | * | 8/2001 | Schulte | 347/15 |
| 2002/0008734 A1 | | 1/2002 | Lee et al. | 347/62 |

FOREIGN PATENT DOCUMENTS

| | | | |
|---|---|---|---|
| EP | 0385757 A2 | 5/1990 | 347/62 |
| JP | 58136462 | 8/1983 | |
| JP | 58162356 | 9/1983 | 347/62 |
| JP | 61167573 | 7/1986 | 347/62 |
| JP | 1087264 | 3/1989 | |
| JP | 2039955 | 2/1990 | |
| JP | 2080261 | 3/1990 | |
| JP | 3045359 | 2/1991 | 347/62 |

* cited by examiner

*Primary Examiner*—Michael S. Brooke
(74) *Attorney, Agent, or Firm*—Luedeka, Neely & Graham PC

(57) ABSTRACT

An improved ink jet printer ejector including a substantially decahedral-donut shaped thin film resistor having a first end, a second end opposite the first end, a major axis having a first length, and a minor axis having a second length less than the first length. The major axis extends between the first end and the second end thereof. Electrical conductors are attached to the first end and to the second end of the resistor for activating the ink ejector on command from the ink jet printer. Decahedral-donut shaped thin film resistors exhibit improved heating characteristics and lower power consumption than conventional heater resistors.

23 Claims, 7 Drawing Sheets

THIN FILM HEATER RESISTOR FOR AN INK JET PRINTER

FIELD OF THE INVENTION

The invention relates to ink ejectors for ink jet printers and specifically to improved thin film heater resistors for ink jet printers.

BACKGROUND

Conventional ink jet printers make use of square or rectangular shaped heater resistors. The primary advantage of square or rectangular shaped thin film resistors is their electrical simplicity. In a square or rectangular shaped resistor, the direct current (DC) resistance is directly proportional to the length/width ratio (L/W), often referred to as the number of squares. By knowing the sheet resistance of the thin film and the L/W ratio, the DC resistance value of the thin film resistor can be calculated.

Unlike in a typical electronic application where a thin film resistor is a passive element in the circuit, the thin film resistor used as an ink ejector in an ink jet printer is an active element. The thermodynamics and hydrodynamics of the ink in conjunction with the thin film resistor make design of these devices much more complicated than if the thin film resistor were a passive element in the circuit. Accordingly, use of square or rectangular shaped resistors, while simplifying the construction, do not lead to the most energy efficient heater resistors. Furthermore, many resistor shapes, including square or rectangular shapes can contribute to ejector misfires due to air build up in ink chambers adjacent the resistors.

There continues to be a need for more energy efficient ink ejectors so that a higher density of ink ejectors can be placed on a printhead chip without excessively heating the chip. There is also a need for heater resistor designs which reduce misfiring caused by air build up in the ink chambers adjacent the chips.

SUMMARY OF THE INVENTION

With regard to the foregoing and other objects and advantages, the invention provides an improved ink jet printer ejector including a substantially decahedral-donut shaped thin film resistor having a first end, a second end opposite the first end, a major axis having a first length, and a minor axis having a second length less than the first length. The major axis extends between the first end and the second end thereof. Electrical conductors are attached to the first end and to the second end of the resistor for activating the ink ejector on command from the ink jet printer.

In another embodiment, the invention provides an ink ejector for an ink jet printer having a substantially uniform surface temperature profile and a substantially non-uniform current density distribution. The ink ejector includes a thin film resistor having a first segment and a second segment attached at an angle on a first end thereof to a first end portion disposed between the first and second segments, a third segment and a fourth segment attached at an angle on a first end thereof to a second end portion disposed between the third and fourth segments and on a second end thereof to the first and second segments. The resistor has a major axis having a first length, and a minor axis having a second length less than the first length. The major axis extends between the first end portion and the second end portion thereof. Electrical conductors are attached to the first end portion and to the second end portion of the resistor for activating the ink ejector on command from the ink jet printer.

In yet another embodiment, the invention provides ink ejector for an ink jet printer including a thin film resistor having opposed edges attached to conductors, a center portion disposed between the opposed edges, and a shape that promotes a non-uniform current density distribution in the thin film resistor and a first temperature adjacent the opposed edges that is greater than a second temperature of the center portion of the resistor.

The invention provides a number of specific advantages over conventional ink ejectors. For example, any air bubbles trapped in corners of the ink chamber are more readily forced out with the ink upon activation of the ink ejector because, as explained in more detail below, nucleation does not begin in the center section of the ink chamber. Another advantage is that ink ejection can be achieved with lower energy and correspondingly lower surface temperature since there is a more uniform heating of the thin film resistor used as the ink ejector. A high impedance thin film resistor can be made from conventional resistor material for use as the ink ejector thereby providing the ability to increase the impedance of power transistors connected to the ink ejector.

BRIEF DESCRIPTION OF THE DRAWINGS

The above and other aspects and advantages of the invention will become further apparent by reference to the following detailed description of preferred embodiments when considered in conjunction with the accompanying drawings in which.

DETAILED DESCRIPTION OF THE PREFERRED EMBODIMENTS

Ink ejection devices for ink jet printers include thin film resistor devices and piezoelectric devices. Both ink ejection devices have been in common use for a number of years. With the advent of higher speed, higher quality ink jet printers, improvements are constantly being sought to reduce power consumption, increase reliability, and increase the ejection device density on a printhead substrate. The ink ejection devices of the invention enable significant improvements to be made to thermal ink jet printers as described in more detail below.

Figure 1:
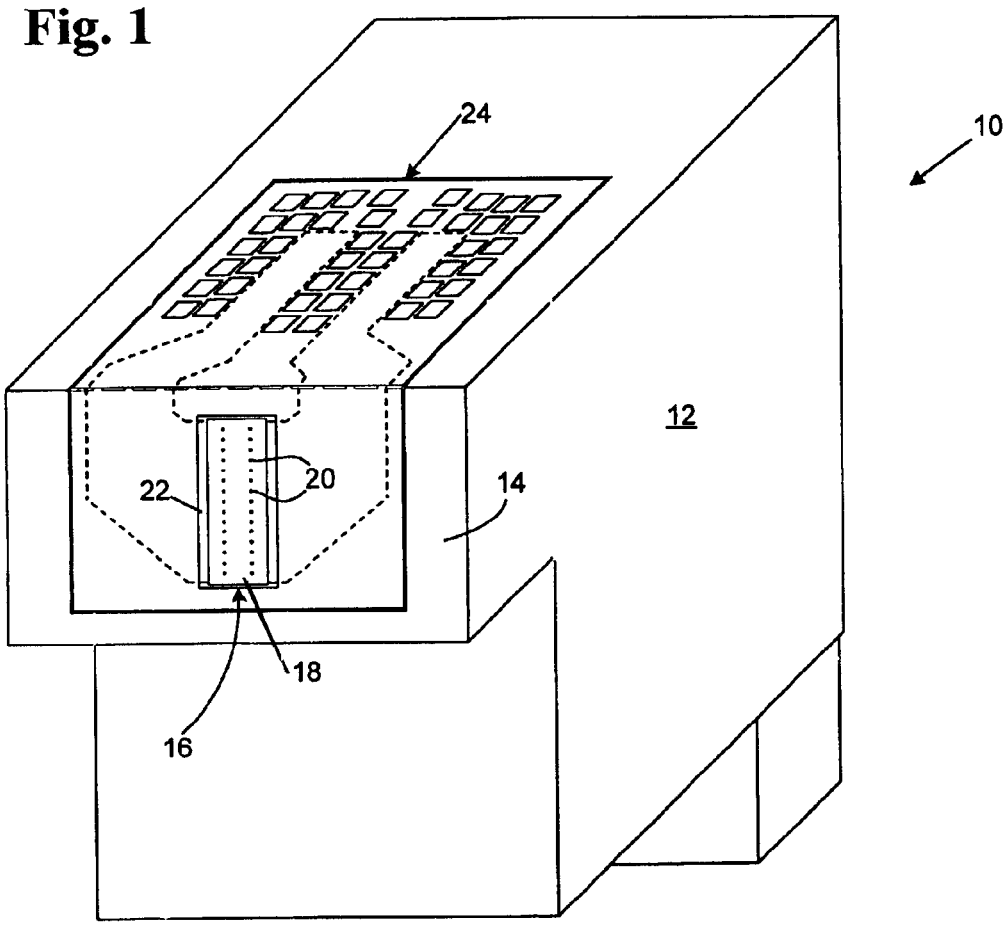
FIG. 1 is a perspective view, not to scale, of an ink jet printer cartridge and printhead for use in an ink jet printer.

With reference to FIG. 1, a typical thermal ink jet printer makes use of an ink cartridge 10 having a cartridge body 12 containing a supply of ink. The ink is fed to a printhead section 14 of the cartridge body 12 that contains a printhead 16. The printhead 16 includes a nozzle plate 18 containing a plurality of nozzle holes 20 and a heater chip 22 containing ink ejection devices as described below. A tape automated bonding (TAB) circuit or flexible circuit 24 provides electrical connection between the ink jet printer and printhead for activating the ink ejectors on command from the printer. While the ink cartridge 10 illustrated in FIG. 1 contains an integral ink jet printhead 16, the invention is not limited to such, as the printhead may be separate from the cartridge body or may be detachable from the cartridge body.

Figure 2:
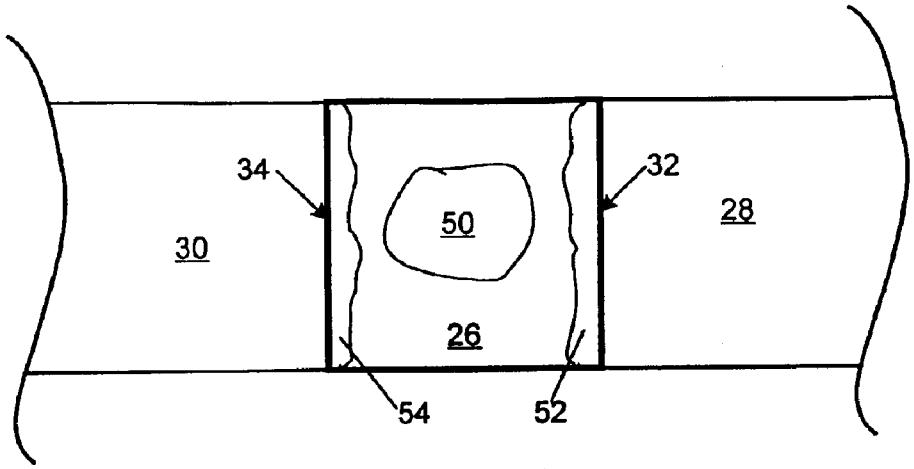
Fig. 2 Prior Art
FIGS. 2, 3, and 4 are plan views, not to scale, of prior art ink ejection devices for thermal ink jet printers.
Figure 3:
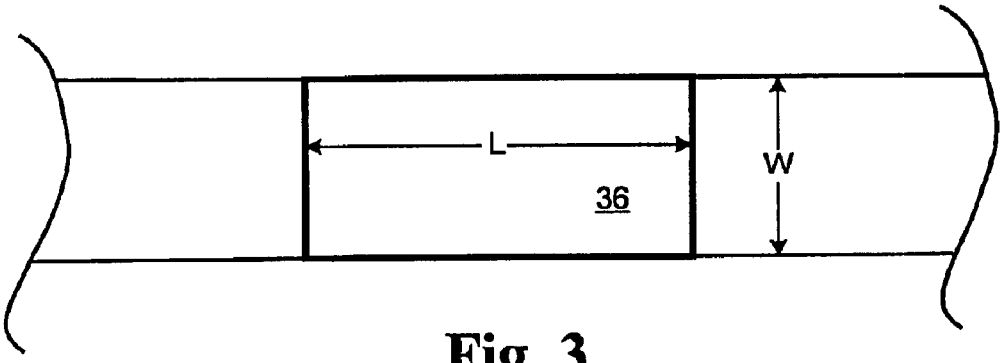
Fig. 3 Prior Art
Figure 4:
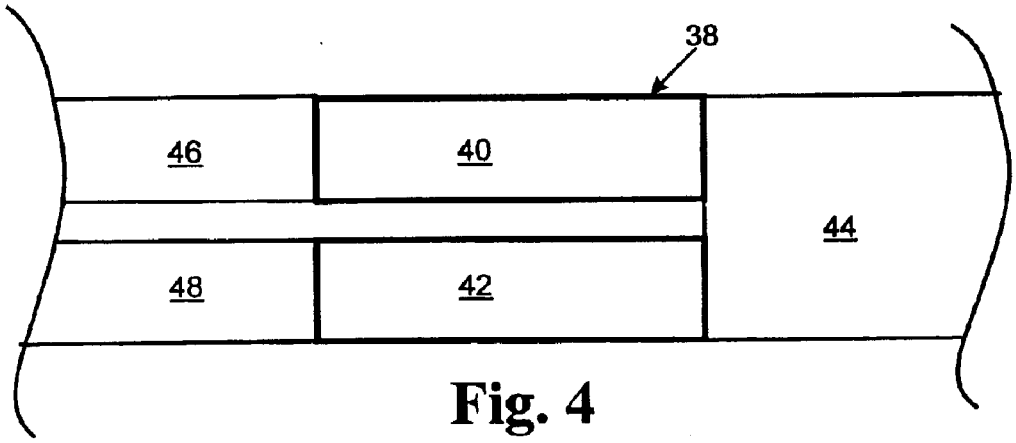
Fig. 4 Prior Art

Conventional thin film resistor ink ejection devices for use in ink jet printheads 16 are shown in FIGS. 2–4 below. In FIG. 2, an ink ejection device 26 is a substantially square-shaped thin film resistor having electrical conductors 28 and 30 attached to opposed edges 32 and 34 thereof. In this case, conductor 28 is a cathode and conductor 30 is an anode. An advantage of a square-shaped ink ejection device 26 is its electrical simplicity. The resistance value of the square-shaped ink ejection device 26 is directly proportional to a length (L) to width (W) ratio (L/W), referred to hereinafter as "the number of squares". In the case of a square-shaped ink ejection device 26, L=W so L/W=1.0 and the resistance value of the ink ejection device is equal to the sheet resistance of the thin film material. The sheet resistance of a conventional tantalum/aluminum (Ta/Al) resistor material is about 28 ohms per square. Accordingly, in order to provide ink ejectors having higher resistance values, materials having higher sheet resistance must be used.

In FIG. 3, an ink ejection device 36 has a substantially rectangular shape. In this case if the length L is 37 microns and the width W is 14 microns, the L/W ratio is about 2.6 squares. So the ink ejection device 36 made from a material having a sheet resistance of about 28 ohms per square would have a resistance value of about 73 ohms.

FIG. 4 is a variation on the rectangular-shaped ink ejection device. In this case, an ink ejection device 38 is made from two rectangular thin film resistors 40 and 42 connected to a cross-over conductor 44 on one end and to separate anode 46 and cathode 48 conductors on the opposite end. In this case, the thin film resistors 40 and 42 behave like two rectangular resistors in series. Hence, the resistance value of ink ejector 38 for each resistor having about 2.25 squares using a material having a sheet resistance of 28 ohms per square is about 126 ohms.

Figure 5:
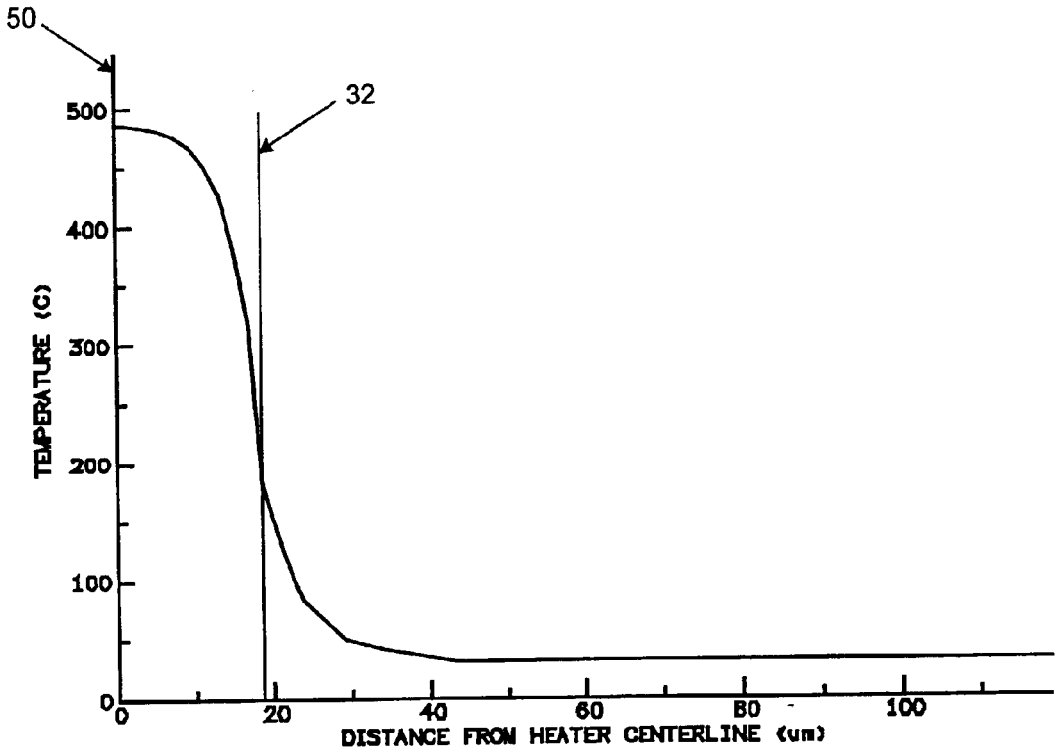
FIG. 5 is a graphical representation of temperature distribution on a surface of a prior art ink ejection device for a thermal ink jet printer.

One disadvantage of each of the ink ejection devices 26, 36 and 38 described above is that the current density is uniform over the surface of the thin film resistors. However, uniform current density leads to non-uniform heating of the thin film materials. In the case of square or rectangular-shaped ink ejection devices such as device 26 a hot spot is typically formed toward the center area 50 of the ink ejection devices while portions 52 and 54 adjacent edges 32 and 34 are relatively cooler. A temperature profile from the center area 50 to one edge 32 is shown in FIG. 5. As seen in FIG. 5, the center area 50 of ink ejector 26 is substantially hotter than the edge 32 when moving from the center portion 50 to the edge 32. The same temperature profile holds true for ink ejection devices 36 and 38.

Figure 6:
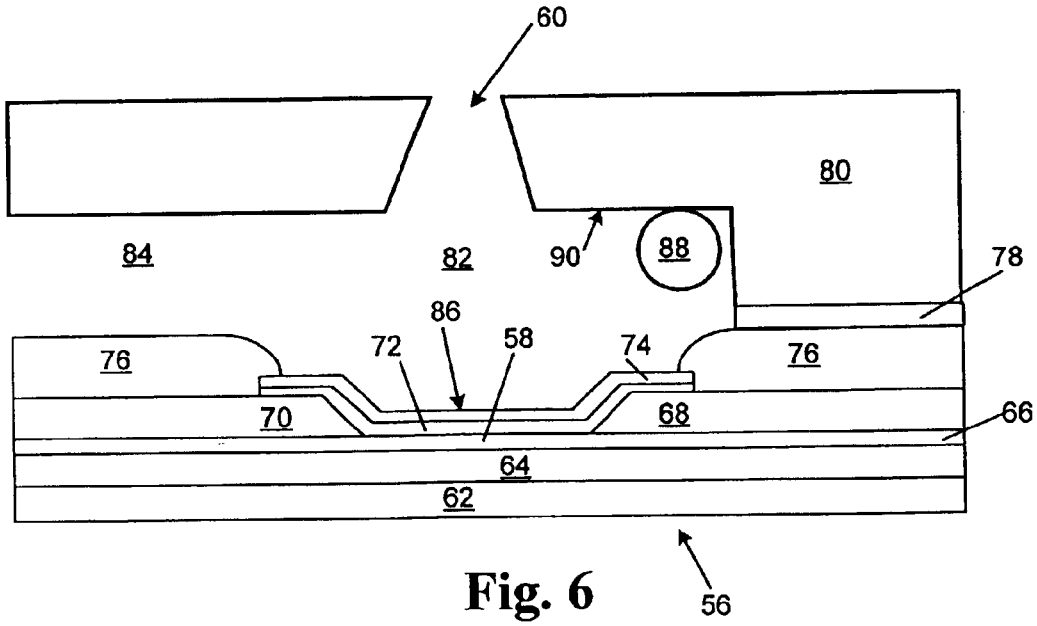
FIG. 6 is a cross sectional view, not to scale, of a portion of an ink jet printhead for a thermal ink jet printer.

The purpose of a thermal type ink ejection device is to generate a vapor bubble in an ink chamber for ejection of ink through the nozzle holes 20 (FIG. 1). FIG. 6 provides a cross-sectional view of a portion of a thermal ink jet printhead device 56 containing an ink ejection device 58 and associated ejection nozzle hole 60. The ink jet printhead 56 includes a substrate material, preferably a silicon substrate 62, a thermal insulation layer 64, a thin film resistor material 66, a first metal conductor layer providing an anode 68 and a cathode 70 in electrical contact with portions of the thin film resistor material 66, a passivation layer 72, a cavitation layer 74, a dielectric insulating layer 76, a second metal conducting layer 78, and a nozzle plate material 80 providing an ink chamber 82, an inlet ink channel 84, and the nozzle hole 60.

Upon activation of the ink ejection device 58, ink in the ink chamber 82 adjacent the cavitation layer 74 begins to boil and forms a vapor bubble that acts like a positive displacement pump to force ink out of the ink chamber 82 through nozzle hole 60 and onto a print media adjacent the printhead 56. Ideally all of the electrical energy input into the thin film resistor layer material 66 by means of the anode 68 and cathode 70 is converted to heat energy for heating ink in the ink chamber 82. However, because of passivation layer 72 and cavitation layer 74, additional energy is required heat the ink to the desired nucleation temperature. Accordingly, the thickness of layers 72 and 74 is typically minimized to reduce the energy required to eject a droplet of ink through nozzle hole 60.

In order to create a vapor bubble in ink chamber 82, a current pulse is applied to ink ejection device 58 for a period of time long enough to generate a temperature high enough to boil the ink on a surface 86 of the cavitation layer 74. In order to provide predictable droplet ejection, the surface temperature of cavitation layer 74 must boil the ink at its superheat limit. Many of the ink compositions used in ink jet printers are water based ink formulations. For water-based ink formulations, the superheat limit is about 320° C. So the ink ejection device 58 must generate a surface temperature of the surface 86 of at least about 320° C. for each and every ink droplet ejected through nozzle 60.

As explained above, the edge portions 52 and 54 of a conventional ink ejection device 26 are substantially cooler than the center portion 50 of the device 26. Accordingly, in order to generate a vapor bubble wherein most of the surface 86 of the ink ejection device 26 participates in bubble nucleation, the center portion 50 of the device 26 must be driven to a temperature well in excess of 320° C. so that the edge portions 52 and 54 will approach the desired nucleation temperature. In this case, it has been observed that the center portion 50 of the ink ejection device 26 must approach about 500° C. in order for the edge portions 52 and 54 to approach 320° C. Hence, considerable excess energy must be input to ejection devices 26, 36 and 38 for those devices to reliably eject a droplet of ink each time they are activated by an electrical pulse from the ink jet printer.

Figure 7:
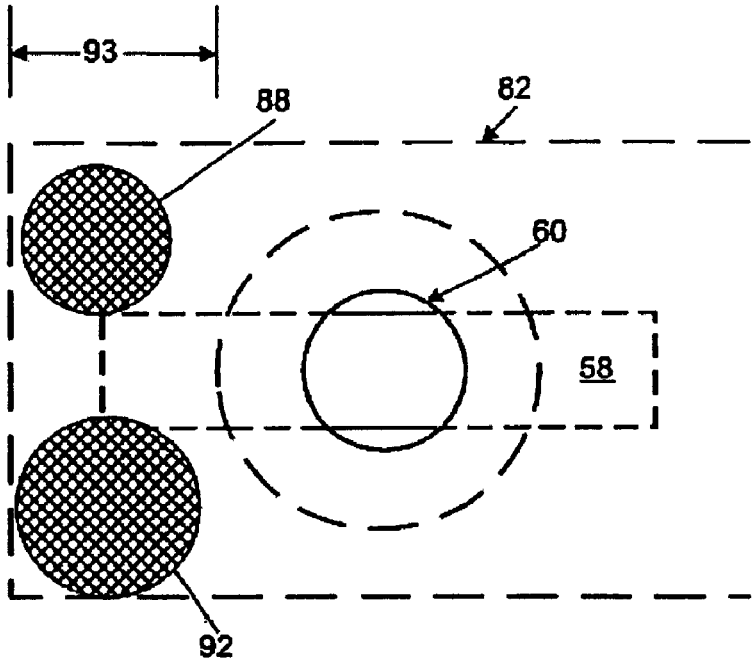
FIG. 7 is a plan view, not to scale, of a portion of a prior art ink ejection device in an ink chamber of a thermal ink jet printhead.

One problem associated with thermal ink ejection devices is that air dissolved in the ink formulation is forced out of solution when the ink is heated. A water-based ink formulation typically contains about 14.5 ppm dissolved air. As the ink is heated, less air remains in solution. For example, for ejection of from about 2 to about 5 nanograms of ink, about $1.4\times10^{-18}$ moles of air comes out of solution on each ejector activation cycle. As the ink temperature increases more air is devolved from the ink formulation. Air bubbles 88 formed from the air coming out of solution tend to accumulate in corners or dead flow zones of the ink chamber 82 particularly in roof areas 90 toward the edges of the ink ejection device. If there is insufficient ink flow in the dead flow zone areas, the bubbles will continue to grow and affect ink flow into and out of the ink chamber 82. Periodic removal of air bubbles from the ink chamber 82 is required otherwise a 10 micron air bubble can form after 15,600 ejection cycles. FIGS. 6 and 7 illustrate the position of air bubbles 88 and 92 in the dead flow zone 93 of an ink chamber 82 of a conventional printhead 56 that may be difficult to remove upon activation of the ejection device 58.

Figure 8:
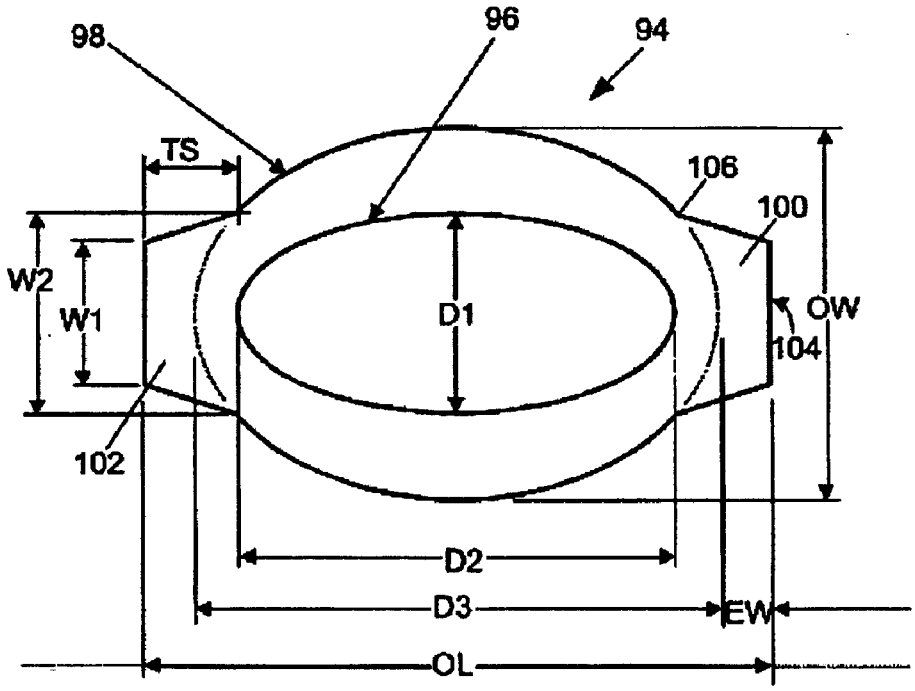
FIGS. 8, 9, and 10 are plan views, not to scale, of ink ejection devices according to the invention.
Figure 9:
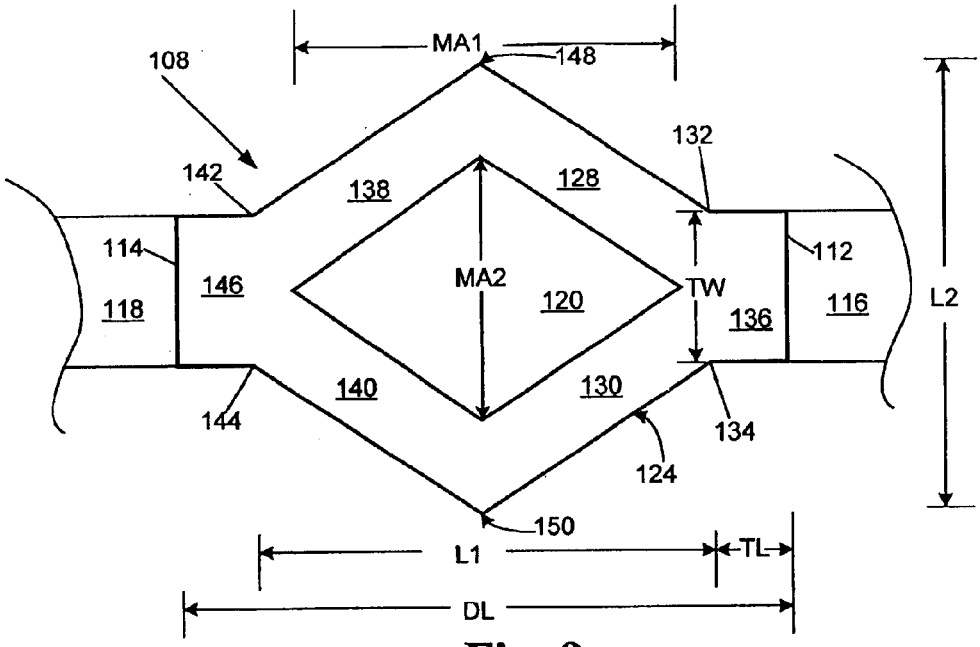
Figure 10:
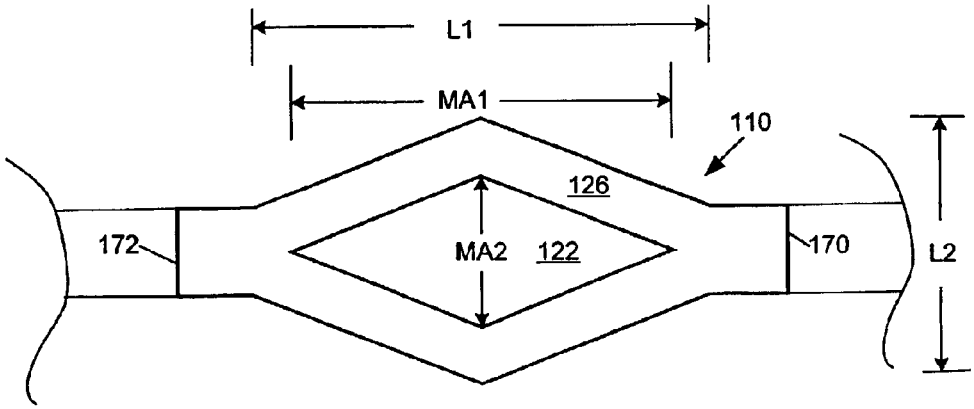

With reference now to FIGS. 8, 9, and 10, preferred ink ejection devices according to the invention will now be described. In FIG. 8, an oval donut-shaped ink ejection device 94 is provided. The device 94 has an overall length (OL) much greater than an overall width (OW) to provide a thin film heater having an equivalent of about 4 squares or more when the thin film resistor material used to make the ink ejection device is TaAl. For example, in FIG. 8, ink ejection device 94 has an open area 96 devoid of resistor material surrounded by oval-shaped resistor material 98. Edge portions 100 and 102 of the ink ejection device 94 are disposed on elongate ends of the device 94 for connecting the device 94 to anode and cathode connectors as described above. The width of the edge portions 100 and 102 EW is preferably less than about 10 percent of the OL of the ink ejection device 94. With respect to the open area 96, a major diameter D2 is preferably about 3 times a minor diameter D1. Likewise, major diameter D3 of the oval-shaped resistor material 98 is preferably about 1.4 to about 1.6 times the OW of the device 94. Each of the edge portions 100 and 102 is preferably tapered to provide a narrow end 104 attached to an anode or cathode and a wide end 106 attached to the oval-shaped resistor material 98. The tapered section (TS) preferably has a length less than length W1 and W1 preferably has a length less than W2. Without desiring to be limited thereto, the following table provides typical dimensions of an oval-shaped resistor 94 according to FIG. 8.

TABLE 1

| Oval-Shaped Resistor 80 having 4.11 squares | |
|---|---|
| Dimension | Typical in microns |
| OL | 43 |
| OW | 22 |
| EW | 3.5 |
| D1 | 10 |
| D2 | 30 |
| D3 | 36 |
| TS | 7.6 |
| W1 | 10 |
| W2 | 14 |

FIGS. 9 and 10 provide alternative preferred embodiments of ink ejection devices according to the invention. In FIGS. 9 and 10, ink ejection devices 108 and 110 are substantially decahedral-donut shaped thin film resistors. Since both the devices 108 and 110 have substantially the same configurations with different dimensions, a detailed description of the features of device 108 also applies to device 110. Device 108 has a first edge 112, a second edge 114 opposite the first edge 112, a major axis having a first length L1, and a minor axis having a second length L2 less than the first length L1. Electrical conductors 116 and 118 are preferably attached to the first and second edges 112 and 114 to provide anode and cathode connections for activating the ink ejector 108 on command from an ink jet printer.

Like the embodiment shown in FIG. 8, ejection devices 108 and 110 also preferably contain open areas 120 and 122 devoid of resistor material surrounded by resistor material 124 and 126. Each of the open areas 120 and 122 is defined by a diamond-shaped area having a major axis having a length (MA1) and a minor axis having a length (MA2). The resistor material, such as material 124, is provided by a first segment 128 and a second segment 130 attached on an angle on first ends 132 and 134 thereof to a first end portion 136 between the first and second segments 128 and 130. Third and fourth segments 138 and 140 are attached on an angle on first ends 142 and 144 thereof to a second end portion 146 disposed between the third and fourth segments 138 and 140. Second ends 148 and 150 of the first, second, third, and fourth segments 128, 130, 138, and 140 are attached to one another to provide the diamond-shaped open area 120. First and second end portions 136 and 146 include rectangular shaped tabs having a tab length (TL) and a tab width (TW) and provide connecting areas for attaching electrical conductors 116 and 118 to the resistor material 124.

Ink ejection device 110 is similar to ink ejection device 108 in that the device 110 has a first length L1 much greater than a second length L2 to provide a thin film heater having an equivalent of about 4 squares or more when the thin film resistor material used to make the ink ejection device is TaAl. The tab length TL is preferably less than about 10 percent of the major axis length L1 of the ink ejection device 110. The tab width TW is preferably about 3 times the TL. With respect to the open area 122, the major axis length MA1 is preferably about 2 to about 4 times the minor axis length MA2. Without desiring to be limited thereto, the following tables provide typical dimensions of ink ejection devices according to FIGS. 9 and 10.

TABLE 2

| Decahedral Donut-Shaped Ejectors having about 4 squares | |
|---|---|
| Dimension For Ejector 108 | Typical in microns |
| OL | 43 |
| L1 | 36 |
| L2 | 26 |
| MA1 | 30 |
| MA2 | 14 |
| TL | 3.5 |
| TW | 10 |

TABLE 3

| Decahedral Donut-Shaped Ejectors having about 4 squares | |
|---|---|
| Dimension For Ejector 110 | Typical in microns |
| OL | 43 |
| L1 | 36 |
| L2 | 20 |
| MA1 | 30 |
| MA2 | 8 |
| TL | 3.5 |
| TW | 10 |

Figure 11:
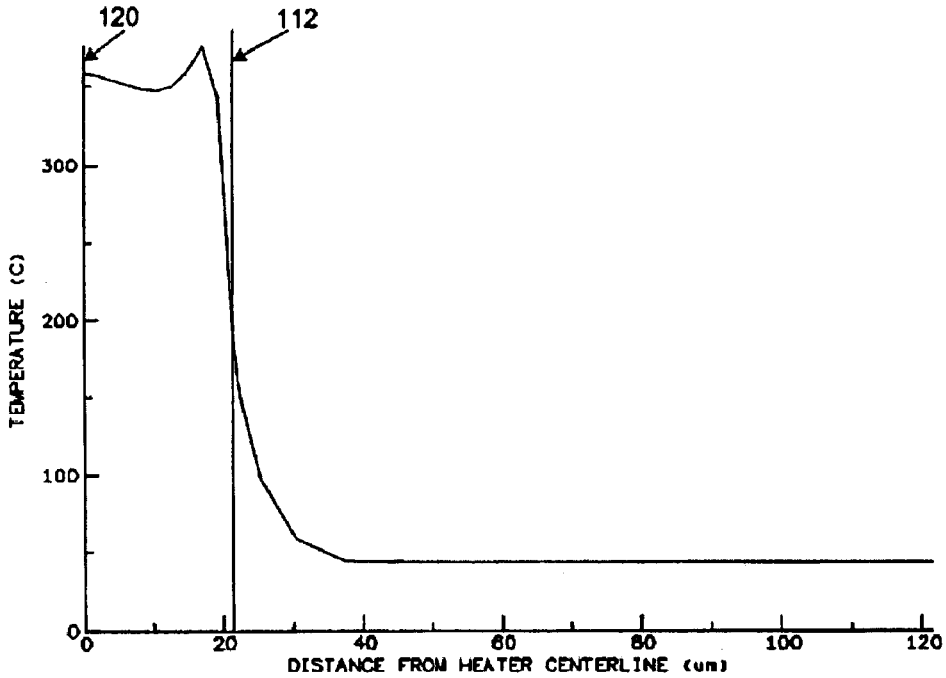
FIG. 11 is a graphical representation of temperature distribution on a surface of an ink ejection device for an ink ejection device according to the invention.

An important advantage of the ink ejection devices 94, 108, and 110 is that there is substantially more uniform heating of the ink contact surface of the ejection devices so that the highest temperature portions of the device are closer to the edges thereof, such as edge 112 (FIG. 9), than for conventional ink ejection devices. A typical temperature distribution on the surface of a cavitation layer overlying ink ejection devices according to the invention is shown in FIG. 11. Contrasting FIG. 11 with FIG. 5 it is evident that there is more uniform heat distribution from the center portion, such as portion 120 (FIG. 9), of ink ejection devices 94, 108 and 110 when moving toward edge 112 than is provided by conventional ink ejection devices 26, 36 and 38 illustrated in FIG. 5. Without desiring to be bound by theory, it is believed that the foregoing ink ejection device shapes according to the invention bias the current density so as to produce higher temperatures toward the electrical conductors, such as conductors 116 and 118, than in the center portions, such as open area 120 (FIG. 9).

By providing more uniform surface temperature distribution, it is not necessary to overheat the central areas of the ink ejection devices 94, 108, and 110 in order to use more of the surface area of the ink ejection device for bubble nucleation. Since, less energy input is required for nucleation of ink using ink ejection devices according to the invention, the ink ejection devices of the invention may be operated at less than 0.2 microjoule per nanogram ink ejected.

Another advantage of the ink ejection devices according to the invention is that the devices promote the start of nucleation near the electrical conductors, such as conductors 116 and 118, of the devices rather than in the central portions of the devices due to the lack of resistive material in the open area, such as open area 120 (FIG. 9) of the devices. By promoting nucleation near the electrical conductor leads, the vapor bubbles are more likely to force air bubbles out of the dead zone areas of the ink chamber.

Figure 12:
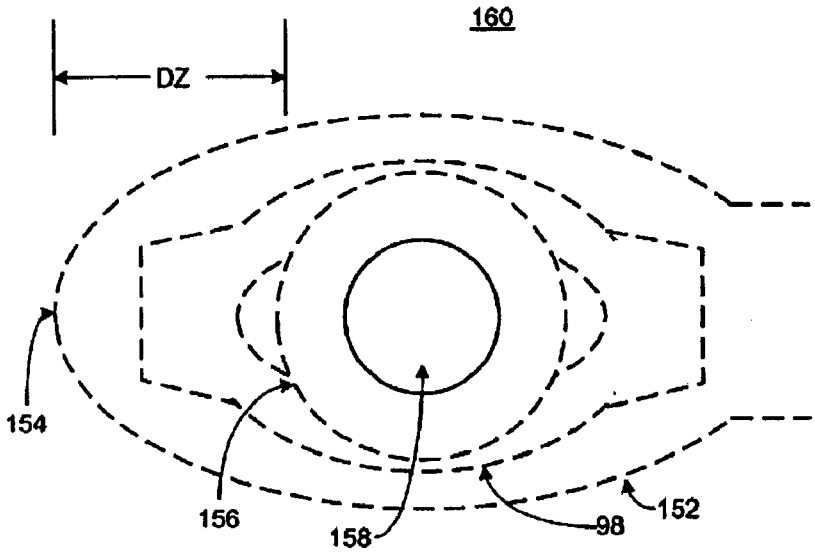
FIG. 12 is a plan view, not to scale, of a portion of an ink ejection device, according to the invention, in an ink chamber of a thermal ink jet printhead.

Because the nozzle holes of an ink jet printhead are generally circular, and the ink chambers are generally elongate to correspond with high impedance ink ejection devices, such as device 94, there remains a substantial dead zone (DZ) in a roof area, such as roof area 90 (FIG. 6), of an ink chamber 152. As shown in FIG. 12, the DZ in the roof area is an ideal location for the accumulation and growth of an air bubble, such as air bubbles 88 and 92 (FIG. 7) between an ink chamber wall 154 and a lower edge 156 of an ink ejection nozzle 158 in a nozzle plate 160.

Figure 13:
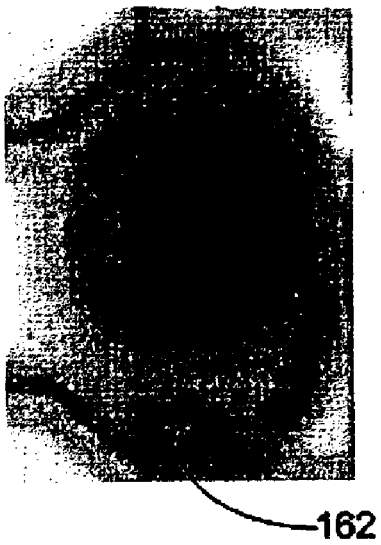
FIG. 13 is a photomicrograph of a prior art ink ejection device containing an air bubble in an ink chamber therefor.

With reference to photomicrographs of actual ink ejection devices, ink ejection devices 26, 36, and 38 as set forth in FIGS. 2, 3, and 4, are more likely to form a trapped air bubble in the roof area 90 of the ink chamber 82 (FIG. 6) as shown by air bubble 162 in FIG. 13 which is a photomicrograph of an actual ink ejection devices, such as device 36 (FIG. 3), in operation. It is believed that nucleation of vapor bubbles tends to form 15 to 20 microns away from the edges of the ink ejection devices set forth in FIGS. 2, 3, and 4 leading to the release of and trapping of air in the dead zones of the ink chamber as described above.

Figure 14:
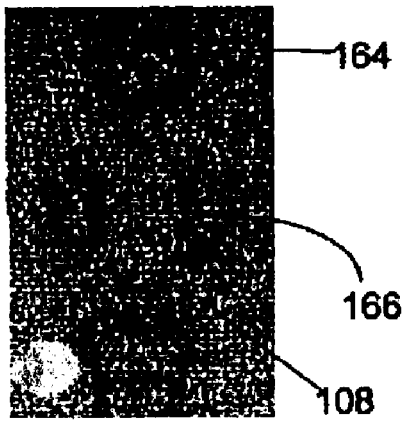
FIGS. 14 and 15 are photomicrographs of nucleation of ink vapor bubbles at the beginning of an ink ejection cycle for ink ejection devices according to the invention.
Figure 15:
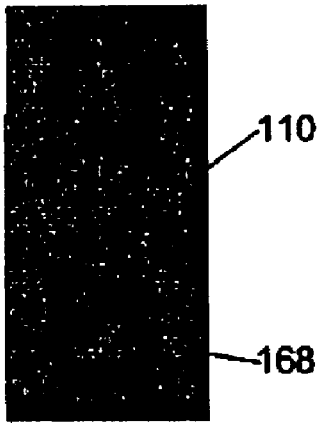

In contrast, nucleation of ink is biased toward the edges of the ink ejection devices of FIGS. 9 and 10 as shown by photomicrographs of the ejection devices 108 and 110 in FIGS. 14 and 15. FIG. 14 shows nucleation vapor bubbles 164 biased toward the first and second edges 112 and 114 of the device in a photograph taken about 600 to 700 nanoseconds into a fire pulse for ejection device 108. Smaller vapor bubbles 166 also form toward the second ends 148 and 150 of the segments 128–140 of the device 108, whereas there is no pronounced vapor formation toward the open area 120 of the device. Accordingly, it is clear from FIG. 14 that the hottest surface areas of the ejection device 108 are toward edges 112 and 114 and second segment ends 148 and 150 as depicted in FIG. 11.

More pronounced biasing of vapor bubble nucleation is shown in FIG. 15 illustrating the operation of device 110 shown in FIG. 10 wherein nucleation vapor bubbles 168 are shown about 600 to 700 nanoseconds into the fire pulse for the ejection device 110. Unlike the device 108, all of the vapor nucleation of the ink begins toward edges 170 and 172 of the device 110. As before, the coolest area of the device 110 during the initial formation of vapor bubbles 168 is toward open area 122 of the device.

Since the nucleation vapor bubbles 164 and 168 of devices 108 and 110 tend to grow from the edges of the ink ejection devices toward the center or open areas 120 and 122, the nucleation vapor bubbles are closer to the location of trapped air bubbles in the dead zones (DZ) of the ink chambers. Since the onset of nucleation is a vapor explosion generating pressures on the order of about 100 atmospheres, these vapor explosions are believed to contribute toward removal of air bubbles from the dead zone locations in the ink chamber. In contrast, a more centrally located vapor explosion as provided by ink ejection devices 26, 36, and 38 tends to force air bubbles into the dead zone areas of the ink chamber where they stay and accumulate.

It is believed that the use of ink ejection devices having open areas between segments provides significantly improved energy utilization whereby the ink ejection devices can be operated without heating any of the surface area of the ejection device significantly above the temperature required for ink nucleation. Accordingly, smaller, higher impedance ink ejection devices may be used to achieve ink ejection as compared to conventional ink ejection devices. By selecting resistor materials having higher sheet resistance values than TaAl, higher impedance ink ejection devices according to the invention may be formed. Increasing the impedance of the ink ejection devices has the added benefit of enabling use of smaller, higher impedance power field effect transistors (FET's) to drive the ink ejection devices. Decreasing the size of a power FET directly increases its DC impedance. However, the parasitic power loss of such a circuit is preferably designed to be less than about 15%. The parasitic power loss is defined as the ratio of the impedance of the circuit other than the ink ejection device to the total impedance of the circuit including the ink ejection device. Since about one third of the surface of the silicon substrate 62 (FIG. 6) for a printhead 16 (FIG. 1) is covered with power FET's, smaller FET's enables an increase in the number of ink ejection devices, and/or a decrease in the size of the silicon substrate thereby providing further advantages.

The foregoing description of certain exemplary embodiments of the present invention has been provided for purposes of illustration only, and it is understood that numerous modifications, alterations, substitutions, or changes may be made in and to the illustrated embodiments without departing from the spirit and scope of the invention.

What is claimed is:

1. An ink ejector for an ink jet printer having a substantially uniform surface temperature profile and a substantially non-uniform current density distribution, the ink ejector comprising a thin film resistor having a first segment and a second segment attached at an angle on a first end thereof to a first end portion disposed between the first and second segments, a third segment and a fourth segment attached at an angle on a first end thereof to a second end portion disposed between the third and fourth segments and on a second end thereof to the first and second segments, the resistor having a major axis having a first length, a minor axis having a second length less than the first length, wherein the major axis extends between the first end portion and the second end portion thereof, and wherein electrical conductors are attached to the first end portion and to the second end portion of the resistor for activating the ink ejector on command from the inkjet printer, wherein the first end portion and the second end portion comprise transition sections between the first, second, third, and fourth segments and the electrical conductors and wherein, the transition sections have a length ranging from about 3 to about 4 microns.

2. The ink ejector of claim 1 wherein a ratio of the first length to the second length ranges from about 1.5:1 to about 4:1.

3. The ink ejector of claim 2 wherein the ratio of the first length to the second length ranges from about 3.5:1 to about 4:1.

4. The ink ejector of claim 1 comprising a resistor having an overall width ranging from about 15 to about 30 microns.

5. The ink ejector of claim 4 comprising a resistor having an overall length ranging from about 35 to about 50 microns.

6. The ink ejector of claim 1 comprising a resistor having an overall length ranging from about 35 to about 50 microns.

7. The ink ejector of claim 1 comprising a resistor having a thin film surface area ranging from about 350 to about 550 $\mu m^2$.

8. An ink jet printhead containing a plurality of ink ejectors according to claim 1.

9. An ink ejector for an inkjet printer comprising a thin film resistor having opposed edges attached to conductors by transition sections, a center portion disposed between the opposed edges, and a shape that promotes a non-uniform current density distribution in the thin film resistor and a first temperature adjacent the opposed edges that is greater than a second temperature of the center portion of the resistor, wherein the thin film resistor has a shape which provides about 4 squares or more and wherein, the transition sections have a length ranging from about 3 to about 4 microns.

10. The ink ejector of claim 9 further comprising a shape that promotes removal of air bubbles from an ink chamber adjacent the resistor when activated by a firing pulse from the ink jet printer.

11. The ink ejector of claim 9 wherein the second temperature of the center portion of the resistor is substantially uniform throughout the center portion.

12. The ink ejector of claim 9 wherein the thin film resistor has a resistance value ranging from about 70 to about 150 ohms.

13. The ink ejector of claim 9 comprising a resistor having a thin film surface area ranging from about 350 to about 550 $\mu m^2$.

14. The ink ejector of claim 9 further comprising a power field effect transistor (FET) coupled to the resistor through a conductor to provide an ink ejector circuit having an overall impedance, wherein the FET has an impedance ranging from about 0.05 to about 0.15 times the ink ejector circuit impedance.

15. An ink ejector for an inkjet printer, the ink ejector comprising a substantially decahedral-shaped thin film resistor having opposed ends, a diamond-shaped area devoid of resistor material between the opposed ends, and substantially rectangular transition sections on the opposed ends, the transition sections being attached to electrical conductors for activating the ink ejector on command from the inkjet printer, the ink ejector having a major axis having a first length between the opposed ends and having a minor axis having a second length less than the first length substantially perpendicular to the major axis.

16. The ink ejector of claim 15 wherein a ratio of the first length to the second length ranges from about 1.5:1 to about 4:1.

17. The ink ejector of claim 15 wherein the ratio of the first length to the second length ranges from about 3.5:1 to about 4:1.

18. The ink ejector of claim 15 wherein the transition sections having a length ranging from about 2 to about 6 microns.

19. The ink ejector of claim 15 comprising a resistor having an overall width ranging from about 15 to about 30 microns.

20. The ink ejector of claim 19 comprising a resistor having an overall length ranging from about 35 to about 50 microns.

21. The ink ejector of claim 15 comprising a resistor having an overall length ranging from about 35 to about 50 microns.

22. The ink ejector of claim 15 comprising a resistor having a thin film surface area ranging from about 350 to about 550 $\mu m^2$.

23. An ink jet printhead containing a plurality of ink ejectors according to claim 15.

* * * * *